US005415386A

United States Patent [19]

Belec et al.

[11] Patent Number: 5,415,386

[45] Date of Patent: May 16, 1995

[54] VERTICAL FEEDING SYSTEM FOR INSERTER

[75] Inventors: Eric A. Belec, Southbury; William J. Wright, Killingworth, both of Conn.

[73] Assignee: Pitney Bowes Inc., Stamford, Conn.

[21] Appl. No.: 247,189

[22] Filed: May 20, 1994

[51] Int. Cl.[6] ..... B65H 39/00

[52] U.S. Cl. ..... 270/58; 271/9; 271/150; 271/149

[58] Field of Search ..... 271/9, 10, 31.1, 34, 271/129, 110, 111, 149, 150; 270/58

[56] References Cited

U.S. PATENT DOCUMENTS

| | | | |
|---|---|---|---|
| 3,756,586 | 9/1973 | Craft | 271/9 |
| 3,966,193 | 6/1976 | Storace et al. | 271/150 |
| 4,423,826 | 1/1984 | Hirata et al. | 271/9 |
| 4,428,501 | 1/1984 | Osako | 271/9 |
| 4,518,158 | 5/1985 | Goi | 271/9 |
| 4,688,782 | 8/1987 | Browne | 271/9 |
| 4,986,522 | 1/1991 | Paulson | 271/9 |
| 5,192,066 | 3/1993 | Steinhilber | 271/9 |

FOREIGN PATENT DOCUMENTS

| | | | |
|---|---|---|---|
| 0088737 | 4/1987 | Japan | 271/9 |
| 0169431 | 6/1990 | Japan | 271/9 |
| 8905767 | 6/1989 | WIPO | 271/34 |

*Primary Examiner*—H. Grant Skaggs
*Attorney, Agent, or Firm*—Charles R. Malandra, Jr.; Melvin J. Scolnick

[57] ABSTRACT

Apparatus and method for collating documents on edge. The apparatus includes: a document transport for conveying documents on edge along a path; at least two hoppers located adjacent the document path for supporting a plurality of documents on edge; a device for continuously conveying the documents through the document transport; and a device for intermittently feeding the documents from the hoppers to the document transport.

6 Claims, 4 Drawing Sheets

VERTICAL FEEDING SYSTEM FOR INSERTER

BACKGROUND OF THE INVENTION

The instant invention relates to a feeding system for an inserting machine, and more particularly to such a system which feeds the documents to be inserted on edge.

Current inserting systems feed and collect a plurality of documents and then register the collation prior to the collation being inserted into an envelope. The documents generally are handled in a horizontal or substantially horizontal plane, which means that there is only one registration edge available, i.e. the lead edge of the document. In an effort to gain a second registration edge, systems have been utilized which process documents on edge, so that there are two registration edges, i.e. the lead edge and the bottom edge. However, current inserting systems which process documents on edge require that the collation, as it is being is processed and built up to its final total, be indexed, i.e. stopped, at the various feeding hoppers in order to collect the documents to be added to the collation from each of the various feeding hoppers. Obviously, such indexing slows down the collating and inserting process.

The instant invention thus overcomes the disadvantage associated with indexing the advancing, on-edge collation and provides a method and apparatus for assembling a collation on edge without ever having to index, i.e. stop, the documents once they have become part of the advancing collation.

SUMMARY OF THE INVENTION

Accordingly, the instant invention provides apparatus for collating documents on edge. The apparatus includes: a document transport for conveying documents on edge along a path; at least two hoppers located adjacent the document path for supporting a plurality of documents on edge; means for continuously conveying the documents through the document transport; and means for intermittently feeding the documents from the hoppers to the document transport.

The instant invention also provides a method of collating documents on edge. The method includes singulating documents on edge from at least two hoppers; intermittently feeding the singulated documents to a feed path; and continuously feeding the documents along the feed path.

DETAILED DESCRIPTION OF THE PREFERRED EMBODIMENT

Figure 1:
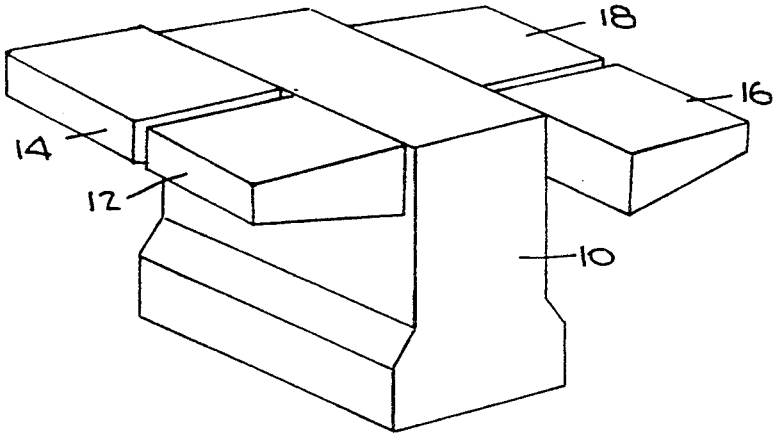
FIG. 1 is a perspective view of the configuration of a document transport module with four hoppers in accordance with the instant invention.
Figure 2:
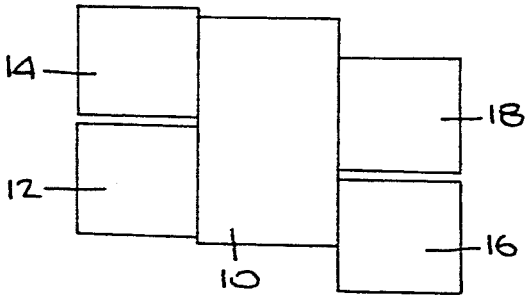
FIG. 2 is a top view of the configuration seen in FIG. 1.
Figure 6:
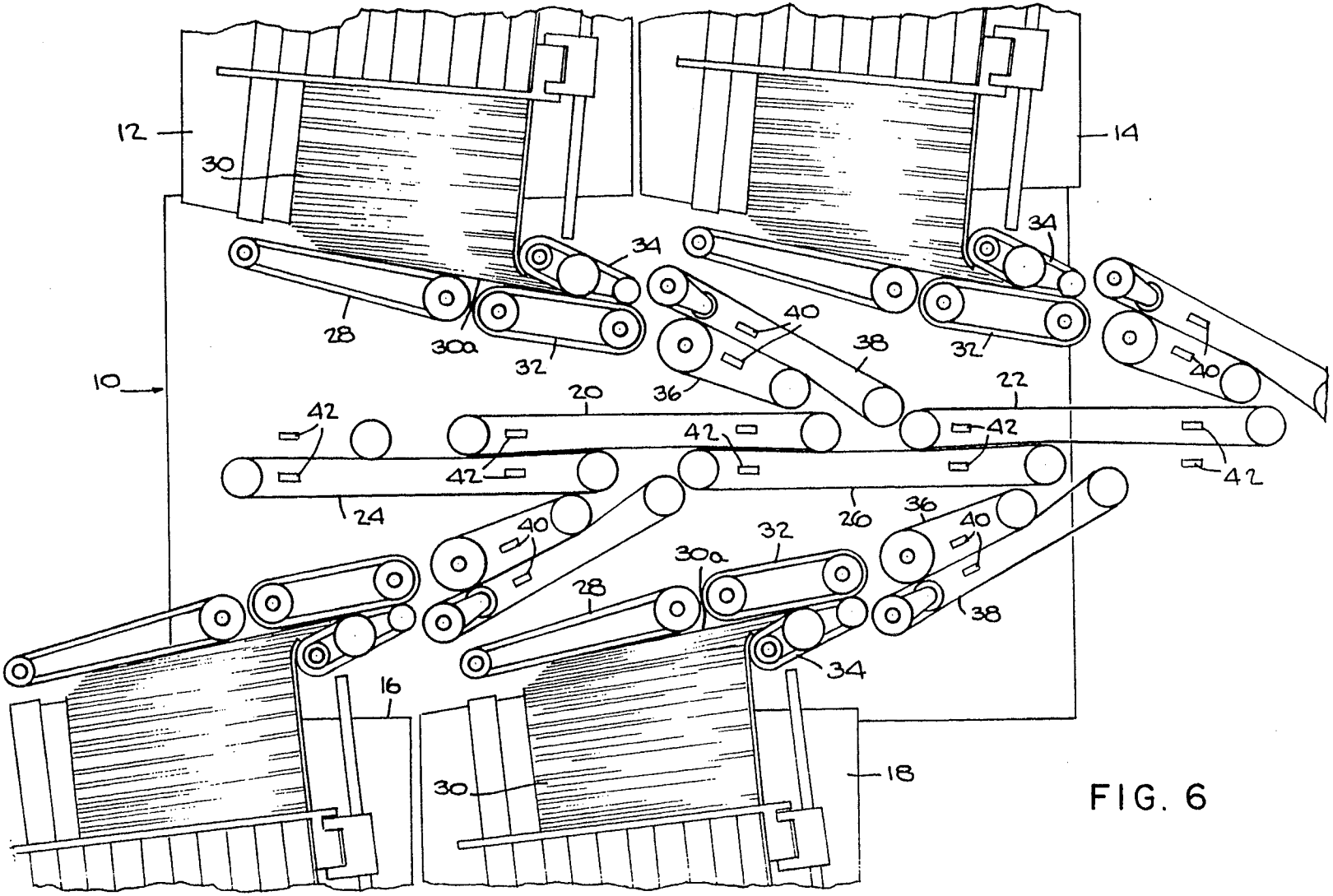
FIG. 6 is a top, plan view of the apparatus represented in FIG. 2.
Figure 7:
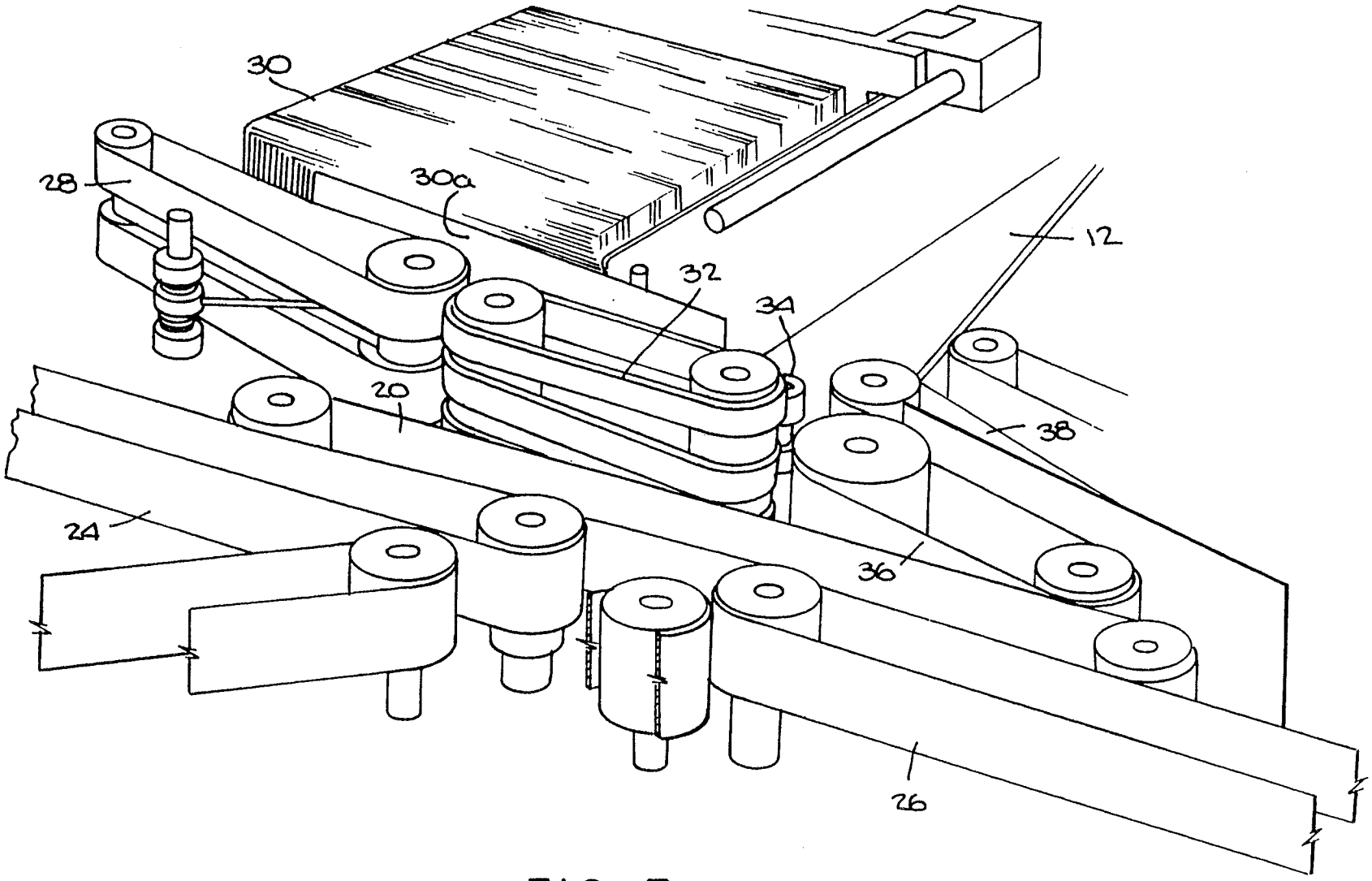
FIG. 7 is a perspective view of the apparatus seen in FIG. 6.

In describing the preferred embodiment of the instant invention, reference is made to the drawings, wherein there is seen in FIG. 6 a document transport module generally designated 10 for use in a conventional inserting system (not shown). The module 10 includes four hoppers 12, 14, 16 and 18 secured thereto. The transport module 10 contains all the conventional mechanisms associated with singulation, staging and transport of individual documents (to be discussed hereinbelow) fed from each of the hoppers 12, 14, 16 and 18 as well as the mechanisms associated with the transport of the collation (to be discussed hereinbelow). Each hopper 12, 14, 16 and 18 provides the capability to advance a vertically oriented stack of documents into its respective singulation mechanism which then feeds the singulated document into a collation as it is generated. Each hopper 12, 14, 16 and 18 is cantilevered off the primary transport module 10 such that the transport module 10 provides the support for all associated mechanisms (see FIG. 1).

Referring again to FIG. 6, it can be seen that the primary transport module 10 includes a series of four, continuously running, endless, transport belts 20, 22, 24 and 26. The first two belts 20 and 22 are adjacent the hoppers 12 and 14 and are staggered with respect to their opposing belts 24 and 26.

In discussing the hoppers 12, 14, 16 and 18, reference will be made to hopper 12, but it is to be understood that all of the hoppers 12, 14, 16 and 18 are identical and include identical pads. The hopper 12 includes an urge belt 28 for urging the innermost document 30*a* in the stack of documents 30 toward the singulation apparatus which consists of a feed belt 32 and a retarding belt 34. Downstream of the singulation belts 32 and 34 is the staging (or arming) area consisting of a pair of cooperating staging belts 36 and 38 which ultimately feed the singulated documents 30 to the transport module 10 and specifically the transport belt 26. The singulated documents 30 reach the transport belt 26 by entering the gap between the transport belts 20 and 22.

Located between each of the staging belts 36 and 38 is a sensor 40 so that the presence or absence of a document 30 can be detected. Similarly, the transport module 10 includes sensors 42 which detect the presence or absence of documents 30 between the transport belts 20, 22, 24 and 26. While the transport belts 20, 22, 24 and 26 and the urge belt 28 run continuously, the sensors 40 and 42, based upon the presence or absence of documents 30, determine when to turn on staging belts 36 & 38 to merge an "armed" document with the collation traveling down transport belts 20, 22, 24 & 26. Having a known velocity of the collation traveling down transport 10, the necessary acceleration of the "armed" document can be determined to merge the lead (or trail) edge of the "armed" document with the lead (or trail) edge of the collation within 0.10". When the sensor 40 is clear, the corresponding hopper again feeds a document into the staging belts 36 & 38 to "reload" said staging area. The cycle then continues asynchronously. The documents 30 are assembled into a collation on the transport module 10 between the belts 20 and 22 on one side and the belts 24 and 26 on the other side. Because the belts 20, 22, 24 and 26 run continuously without indexing, the speed of the collating and subsequent inserting process is maximized. The documents 30 are only stopped or indexed by the belts upstream of the transport belts 20, 22, 24 and 26, i.e. in the staging area between the belts 38 and 40 and areas upstream thereof.

Figure 4:
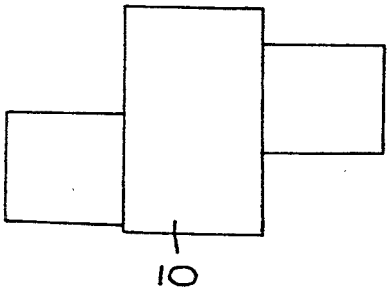
FIG. 4 is similar to FIG. 2 but shows a single document transport with only two hoppers.
Figure 5:
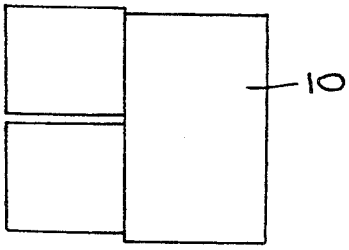
FIG. 5 is similar to FIG. 4 but shows the two hoppers on the same side of the document transport.

It is not necessary to include 4 hoppers 12, 14, 16 and 18 with each transport module configuration. The hoppers 12, 14, 16 and 18 are easily detachable so that several potential configurations are readily available, as seen in FIGS. 2–5. Hoppers could be mounted to each side of the transport 10 as seen in FIG. 4, or to one side of the transport as seen in FIG. 5.

Figure 3:
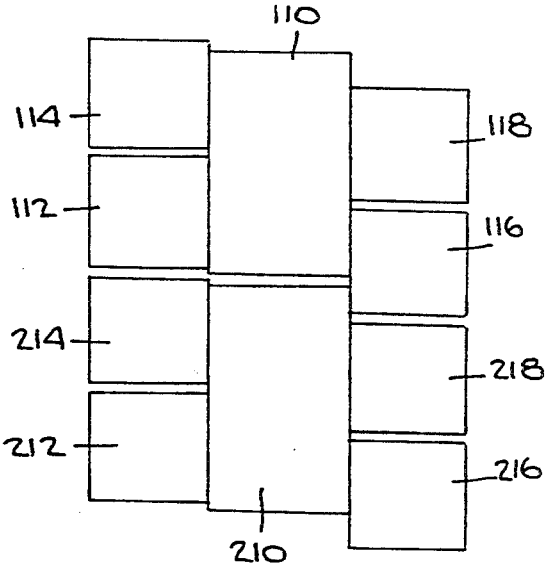
FIG. 3 is similar to FIG. 2 but shows two transport modules with eight hoppers.
Figure 8:
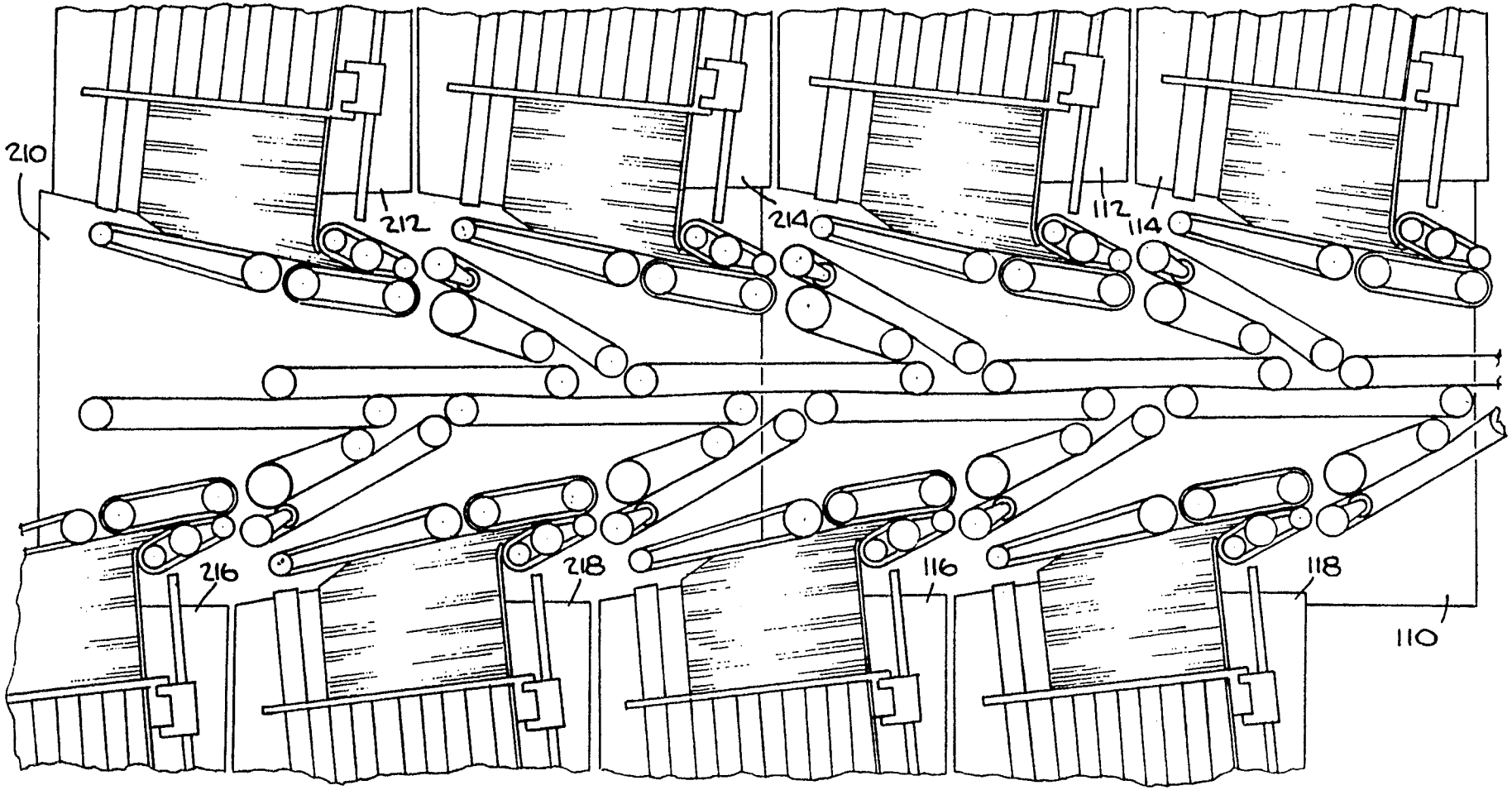
FIG. 8 is a top, plan view of the apparatus represented in FIG. 3.

The modularity of the instant invention allows the transport modules 10 to be stacked upon each other as seen in FIG. 3 to create a collating system having as many hoppers as desired. The configuration in FIGS. 3 and 8 are the result of two transport modules 110 and 210 being coupled together. The transport module 110 includes four hoppers 112, 114, 116 and 118, and the transport module 210 includes four hoppers 212, 214, 216 and 218. By having the capability of stacking the transport modules 10 almost indefinitely, any desired system configuration can be easily attained. The vertical nature of the paper path allows dual-sided feeder capability since documents can be merged from both sides of the transport module 10 which allows the overall length of the collation area to be cut in half.

In operation, referring now to FIG. 6 as an example, a collation would be built by first feeding a document 30 from the hopper 16 through the gap of the belts 24 and 26 toward the belt 20. The belts 20 and 26 would then convey the document 30 through the transport module 10 where it would be joined by documents 30 from the other hoppers 12, 18 and 14 respectively. The documents 30 would be fed toward the transport module 10 as determined by the sensors 40 and 42. Since only the belts 28, 32, 34, 36 and 38, i.e. the belts associated with the hoppers, are stopped, the documents are never indexed or stopped once they arrive at the transport module 10, which results in maximizing the speed of the transport module 10.

Accordingly, it can be seen that a method and apparatus are provided for assembling a collation on edge without ever having to index or stop the documents once they have become part of the advancing collation.

It should be understood by those skilled in the art that various modifications may be made in the present invention without departing from the spirit and scope thereof, as described in the specification and defined in the appended claims.

What is claimed is:

1. Apparatus for collating documents on edge on a moving transport, comprising:

a document transport for receiving and conveying documents on edge along a path;

a plurality of hoppers located adjacent said document path for supporting a plurality of documents on edge, said hoppers being arranged in order from upstream to downstream positions;

means for intermittently feeding any or all of said documents on edge seriatim from said hoppers to said document transport, wherein the order of feeding follows the order of the arrangement of said hoppers;

means for continuously conveying said documents on edge through said document transport as a merged collation; and means for merging each of said documents fed by said feeding means from a downstream position with documents on said document transport from an upstream position, whereby a collation of documents can be formed on said document transport by successively feeding and merging documents in order from an upstream to a downstream position.

2. The apparatus of claim 1, wherein at least one hopper is located on each side of said document path.

3. The apparatus of claim 1, wherein said conveying means comprises a series of continuously running, endless, transport belts.

4. The apparatus of claim 3, wherein said feeding means comprises singulation belts and staging belts.

5. A method of collating documents on edge on a moving transport, comprising:

singulating documents on edge from at least two hoppers located adjacent a document path, said hoppers supporting a plurality of documents on edge and being arranged in order from upstream to downstream positions;

intermittently feeding any or all of said documents on edge seriatim from said hoppers to said document path, wherein the order of feeding follows the order of the arrangement of said hoppers, and each document so fed merges in the document path with documents fed from upstream positions;

continuously conveying said documents on edge through said document path as a merged collation, whereby a collation of documents is formed in said document path by successively feeding and merging documents in order from an upstream to a downstream position.

6. The method of claim 5, wherein at least one hopper is located on each side of said feed path.

* * * * *